US006584294B1

(12) United States Patent
Landa et al.

(10) Patent No.: US 6,584,294 B1
(45) Date of Patent: Jun. 24, 2003

(54) FUSER AND INTERMEDIATE TRANSFER DRUMS

(75) Inventors: Benzion Landa, Nes-Ziona (IL); Avner Schneider, Nes-Ziona (IL); Amiran Lavon, Bat-Yam (IL); Marc Aronhime, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 09/856,649

(22) PCT Filed: Nov. 25, 1998

(86) PCT No.: PCT/IL98/00576

§ 371 (c)(1),
(2), (4) Date: Aug. 6, 2001

(87) PCT Pub. No.: WO00/31593

PCT Pub. Date: Jun. 2, 2000

(51) Int. Cl.[7] ..... G03G 15/01

(52) U.S. Cl. ..... 399/302; 399/330; 399/308; 492/18

(58) Field of Search ..... 492/4, 16–18, 492/46; 100/155 R, 170; 399/96, 159, 302, 308, 330, 331, 307; 432/60; 219/216

(56) References Cited

U.S. PATENT DOCUMENTS

| | | | | | |
|---|---|---|---|---|---|
| 3,574,912 | A | * | 4/1971 | Kraft | 101/348 |
| 4,091,264 | A | * | 5/1978 | Sarcia | 165/104.26 |
| 4,105,896 | A | * | 8/1978 | Schuster | 122/366 |
| 4,172,976 | A | | 10/1979 | Namiki et al. | |
| 4,229,644 | A | | 10/1980 | Namiki et al. | |
| 4,272,872 | A | * | 6/1981 | Hess et al. | 355/85 |
| 4,526,533 | A | * | 7/1985 | Pabst | 165/104.21 |
| 4,717,338 | A | | 1/1988 | Cellier | 432/60 |
| 4,903,597 | A | * | 2/1990 | Hoage et al. | 101/375 |
| 4,945,387 | A | | 7/1990 | Landa et al. | |
| 5,028,964 | A | | 7/1991 | Landa et al. | |
| 5,047,808 | A | | 9/1991 | Landa et al. | |
| 5,089,856 | A | | 2/1992 | Landa et al. | |
| 5,157,238 | A | | 10/1992 | Landa et al. | |
| 5,286,948 | A | | 2/1994 | Landa et al. | |
| 5,335,054 | A | | 8/1994 | Landa et al. | |
| 5,426,495 | A | * | 6/1995 | Sawamura et al. | 165/89 |
| 5,554,476 | A | | 9/1996 | Landa et al. | |
| 5,592,269 | A | | 1/1997 | Younes et al. | |
| 5,636,349 | A | | 6/1997 | Landa et al. | |
| 5,689,767 | A | * | 11/1997 | Domoto et al. | 219/216 |
| 5,984,848 | A | | 11/1999 | Hyllberg et al. | |

FOREIGN PATENT DOCUMENTS

| | | | | | |
|---|---|---|---|---|---|
| EP | 0 523 998 | | | 1/1993 | |
| EP | 0 704 773 | | | 4/1996 | |
| EP | 0 772 100 | | | 5/1997 | |
| EP | 0 775 948 | | | 5/1997 | |
| JP | 54056448 | A | * | 5/1979 | G03G/15/20 |
| JP | 54092750 | A | * | 7/1979 | G03G/15/20 |
| JP | 62056979 | A | * | 3/1987 | G03G/15/20 |
| WO | WO 96/13760 | | | 5/1996 | |
| WO | WO 96/17277 | | | 6/1996 | |
| WO | WO 97/07433 | | | 2/1997 | |
| WO | WO 97/61957 | | | 12/1999 | |
| WO | WO 97/61958 | | | 12/1999 | |
| WO | WO 00/31593 | | | 6/2000 | |

OTHER PUBLICATIONS

Wakabayashi, N.; JP 08–320625; Dec. 3, 1996 & Patent Abstracts of Japan; vol. 097; No. 004; Apr. 30, 1997.

* cited by examiner

*Primary Examiner*—Robert Beatty
(74) *Attorney, Agent, or Firm*—Fenster & Company

(57) ABSTRACT

An apparatus for use as an intermediate transfer member or fusing member in an image forming device includes a cylindrical member having a thickness that is insufficient to support it in use and which is secured between two round end plates to form a cylindrical structure which is unsupported between the endplates. A liquid is incorporated within the cylindrical structure and a heater is also located within the cylindrical structure so as to heat the liquid to produce a vapor wherein the vapor is of a sufficient pressure to support the cylindrical member during use.

52 Claims, 3 Drawing Sheets

FUSER AND INTERMEDIATE TRANSFER DRUMS

RELATED APPLICATIONS

The present application is a U.S. national application of PCT/IL98/00576, filed Nov. 25, 1998.

FIELD OF THE INVENTION

The present invention is related to the field of printers and copiers and more particularly to printers or copiers that utilize fusers, intermediate transfer members and/or elements that function as both fusers and intermediate transfer members.

BACKGROUND OF THE INVENTION

Printers and copiers are well known. Modern copiers that utilize powder or liquid toners comprising toner particles to form visible images generally form a latent electrostatic image on an image forming surface (such as a photoreceptor), develop the image utilizing a toner (such as the aforementioned powder or liquid toners) to form a developed image and transfer the developed image to a final substrate. The transfer may be direct, i.e., the image is transferred directly to the final substrate from the image forming surface, or indirect, i.e., the image is transferred to the final substrate via one or more intermediate transfer members.

In general, the image on the final substrate must be fused and fixed to the substrate. This step is achieved in most copiers and printers by heating the toner image on the substrate. In some copiers and printers the fusing and fixing of the image is performed simultaneously with the transfer of the image to the substrate. This is achieved by utilizing a heated intermediate transfer member to perform the transfer and by pressing the intermediate transfer member against the final substrate. This combination of heat and pressure softens the toner particles and fixes them to the substrate.

These processes and fixers, intermediate transfer members other components and liquid toners suitable for carrying them out and printers utilizing these structures and processes are described in detail in U.S. Pat. Nos. 4,945,387; 5,047,808; 5,028,964; 5,089,856; 5,157,238; 5,286,948; 5,335,054; 5,497,222; 5,554,476; and 5,636,349; and PCT patent publications WO 96/17277, WO 97/07433 and PCT patent applications PCT/IL98/00235 and PCT/IL98/00553, the disclosures of all of which are incorporated herein by reference.

Particular reference is made to U.S. Pat. Nos. 5,047,808; 5,554,476 and 5,636,349 which describe a number of attributes of preferred intermediate transfer members suitable for liquid toner imaging.

U.S. Pat. No. 5,047,808 describes an intermediate transfer member comprised of a rigid core and an overlying intermediate transfer blanket. As described in the patent, a preferred intermediate transfer member provides a first transfer of images from an image bearing surface to the intermediate transfer member and a second transfer of the images from the intermediate transfer member to the final substrate. While both first and second transfers are performed under pressure, second transfer (which includes fixing and fusing of the image to the substrate) is performed under much higher pressure than first transfer. The patent teaches that the deformation per unit pressure during first transfer should be much lower than during second transfer. In other words, the intermediate transfer member should be "harder" for second transfer.

U.S. Pat. No. 5,335,054 provides a particularly advantageous method of achieving this desired characteristic of the intermediate transfer member. This patent describes an intermediate transfer member having two types of layers which contribute to this effect. In particular, the preferred intermediate transfer member as described in this patent has a soft, thin conforming layer, preferably formed of a soft polymer, and a sponge layer underlying the soft conforming layer. These layers provide conformance of the intermediate transfer member with the surface of the image bearing surface at low pressure and relatively low deformation and the desired stiffness of the intermediate transfer member under higher pressure conditions. Advantageously, a plurality of sponge and/or conforming layers are used to provide greater control over the compressibility profile of the member at first and second transfer.

U.S. Pat. No. 5,636,349 describes another desirable characteristic of intermediate transfer members. As described in this patent, the intermediate transfer member should be heated to a temperature at which the image on it adheres to the substrate. While the member is still pressing against the substrate the member is cooled sufficiently such that the cohesion of the image increases to such an extent that the image cohesion forces are greater than those causing adhesion to the member. When these conditions are met, the image is transferred in its entirety from the intermediate transfer member to the final substrate without leaving any appreciable toner residue on the intermediate transfer member.

It can be appreciated that this combination of requirements (and other requirements which have not been mentioned above) places very tight limitations on intermediate transfer members. While intermediate transfer members as described in the prior art can meet these requirements, the transfer parameters must be tightly controlled and the operating window available for these processes is limited. In state of the art systems the required transfer temperatures are provided by heating the drum on which the blanket is mounted, such that the image transfer surface is heated to a required temperature of 90 to 110 degrees Celsius. Higher or lower temperatures are also useful, depending on the polymers used in the toner particles, the carrier liquid used and the speed of the printing process. Since the blanket needs a sponge layer to provide some of the compressibility requirements of the member, and since sponges generally have high thermal impedance, the back of the blanket is much hotter than its transfer surface, often as much as 60–70 degrees hotter.

This results in severe requirements on the materials used in the blanket, which must not only meet the stringent operating requirements mentioned above, but must also do so under high temperature, often much higher than the temperatures required for the actual transfer process. Furthermore, it has been found that the sponge layer is susceptible to damage from paper misfeeds or jams. When a number of sheets are fed together or jams occur, the sponge is sometimes compressed past its recovery point.

Furthermore, it has been found that intermediate transfer members exhibit short term memory effects under certain conditions. These effects manifest themselves in slightly different transfer characteristics for areas which carried an image on a previous transfer from areas which did not (background areas). It is believed that the memory effect is caused by variations in surface temperature on the transfer surface and/or by uneven absorption of carrier liquid from the liquid toner by a surface transfer layer of the transfer member. PCT patent publication WO/96/13760 and U.S.

Pat. No. 5,592,269 provide at least partial solutions to these problems, at the cost of some additional system and/or toner complexity.

Reference is also made to U.S. Pat. No. 5,286,948, which describes a fusing apparatus and method utilizing a thin membrane as a flusing element. The membrane is mounted on two end elements to form a cylindrical drum of which the membrane forms the cylindrical surface. This element, which is generally too thin to support itself, especially during transfer, is supported by gas pressure within the drum and/or by mechanically applied pressure on the end elements to tension the membrane. It should be noted that the gas pressure itself also provides pressure on the end elements to tension the membrane.

It should be understood that while the above background art inventions have been discussed with respect to liquid toner electrophoretic imaging machines, many of the principles described and some of the structure is applicable to powder toner machines and to offset printers utilizing non-electrified inks.

SUMMARY OF THE INVENTION

It is an object of some preferred embodiments of the invention to provide an intermediate transfer member or fuser of improved design and performance.

Preferably, the intermediate transfer member or fuser comprises a thin membrane, as an image transfer and/or flusing element, that is mounted on two end elements to form a cylindrical drum, of which the membrane forms the cylindrical surface. The membrane, which may be too thin to support itself, especially during transfer, is supported by gas pressure within the drum and optionally by mechanically applied pressure on the end elements to tension the membrane. A gas pressure of about two to three atmospheres has been found to be suitable for supporting the membrane. Preferably, a relatively simple intermediate transfer blanket is mounted on the outside of the cylindrical surface.

As indicated in the above background of the invention, the prior art method of providing the compression characteristics is to include in the blanket at least one sponge layer, one conforming layer, one conducting layer and means for electrically connecting to the conductive layer, all of which make the blanket relatively complicated to manufacture and relatively expensive. Such a blanket is expensive to manufacture, has a low heat conductivity and is susceptible to damage from paper missfeeds. It has been found that, fortuitously, when a pressure supported membrane is used as a support for the blanket it is not necessary to provide a sponge layer beneath the conforming layer to achieve the required compression characteristic. It has been found that the deformation of the membrane under external pressure has characteristics sufficiently similar to that of the prior art sponge layer that, with optional changes in the conforming layer, no (or at most a very thin) sponge layer is required.

Under these conditions, with the sponge layer removed, a thinner, much less expensive blanket may be used. This blanket has a much lower thermal resistance and thus, the drum itself need not be heated to as high a temperature as required in the prior art. In particular, it has been found that a temperature differential as low as 20 or 30 degrees Celsius may be sufficient. This lower temperature requirement allows for use of lower temperature materials for adhesives and other components of the blanket and for higher reliability of the blanket as a whole.

In one aspect of some preferred embodiments of the invention, an image transfer member is provided whose temperature is stabilized. In a preferred embodiment of the invention the image transfer member comprises a drum and the temperature is stabilized by incorporating a relatively small quantity of liquid within the drum, preferably in contact with a portion of the inside surface of the cylindrical thin membrane.

The inclusion of the liquid in the drum has a number of positive effects on the operation of the intermediate transfer member. One important unexpected result is a greatly improved stability of the characteristics of the intermediate transfer member.

As indicated above, a membrane drum of the prior art could be used as an intermediate transfer member. One of the advantages of such an intermediate transfer member is its low heat capacity which allows for short warm-up time. However, when an intermediate transfer blanket is mounted on such a drum, some of the problems of such blankets are exacerbated. In particular, use of a low thermal capacity drum makes it more difficult to measure and control the temperate of the drum. In addition, the temperature varies over surface portions of the drum as a function of the angular and axial position of portion, often to an unacceptable degree.

An important limitation of such an intermediate transfer member is that it has a relatively high short term memory. It is believed that local variations in the surface temperature are naturally induced by evaporation of carrier liquid associated with the image. It is believed that areas having toner particles, and associated liquid, cool preferentially between first and second transfer due to the evaporation of carrier liquid associated with the toner particles. While the non-toner areas are also covered with a thin layer of carrier liquid, the evaporation of this thin layer does not reduce the temperature as much as does the evaporation of a greater amount of carrier liquid from the toner covered areas. While it is possible to reduce this effect by increasing the temperature of the drum, this is not an optimal solution for the problem, inter alia because too high a drum temperature may interfere with first transfer or even damage the photoreceptor.

Whatever the source of the short term memory, the inclusion of a liquid, such as water or oil, in the drum appears to sharply reduce the effect. In practice, the liquid forms a "pool" at the lowest portion of the drum. When, during rotation, the drum surface passes through this pool, the temperature of the surface is "reset" to the temperature of the liquid. Furthermore, it is believed that the liquid forms a thin coating of liquid on the inner surface of the membrane. This coating provides a greater heat capacity to the drum, even outside the region of the pool of liquid and reduces the deleterious effect of evaporation of carrier liquid. Generally, only small amounts of liquid are required, of the order of 5% of the volume of the interior of the drum, although lesser or greater amounts may be advantageously used. This small amount of liquid does not change the warm-up time of the drum to an unacceptable degree.

An additional requirement for membrane type drums is the provision of pressure within the drum to support the drum. This was provided, in the prior art reference described above, by sealing the interior of the drum and providing an inlet valve through which the interior was pressurized by a gas. However, while such a system did operate as required, inevitable leakage required monitoring and periodic re-pressurization.

In an especially preferred embodiment of the invention, the liquid in the drum is water. Use of water as the liquid provides an automatic pressure and temperature stabilization feature to the drum. It has been found that, fortuitously, at 120–130 degrees Celsius, the vapor pressure of water is about two to three atmospheres. Thus, if the water (and thus the membrane) is heated to this temperature, a temperature which provides a suitable surface temperature for the transfer surface of the intermediate transfer blanket, the internal pressure is also in an optimum range for image transfer. It should be understood that for powder toner systems a higher temperature and pressure are required, such that use of water for the filling is believed to be suitable for powder toner systems as well. Furthermore, the temperature and pressure desired may vary depending on the speed of the printing process and the polymer and carrier liquid used in the toner.

It should also be noted that when materials are dissolved in the water, the vapor pressure is reduced. Thus, where a higher temperature is desired for a particular pressure, a suitable amount of material is added to the water to reduce the pressure. Alternatively or additionally a mixture of liquids may be used to control the viscosity of the liquid and/or the vapor pressure.

In preferred embodiment of the invention, the drum contains air at at least one atmosphere. This filling with air is desirable to avoid collapse of the drum when it is cooled. Preferably a one way valve is provided such that the pressure in the drum never falls below the outside pressure.

There is thus provided, in accordance with a preferred embodiment of the invention, intermediate transfer member apparatus for transferring visible images from a first surface to a second surface or a fuser for fusing an image on a surface, comprising:

a cylindrical member secured between two round end plates to form a cylindrical structure; and a liquid incorporated within the cylindrical structure.

Preferably, the member includes a heater which heats the liquid. Preferably, the heater heats the liquid and the cylindrical member to a temperature between about 110 degrees Celsius and about 140 degrees Celsius, more preferably, between about 115 degrees Celsius and about 135 degrees Celsius and most preferably, between about 120 degrees Celsius and about 130 degrees Celsius.

In a preferred embodiment of the invention, the heater is a radiant heater situated in the interior of the cylindrical structure. Alternatively, the heater is a conduction heater placed in a pool of the liquid in the cylindrical structure.

In a preferred embodiment of the invention, the cylindrical member forms a seal at the end plates and wherein said cylindrical surface is supported by gas pressure internal to the cylindrical structure. Preferably, the gas pressure is equal to between about 2 and about 3 atmospheres. Preferably, the gas pressure comprises vapor pressure of the liquid.

In a preferred embodiment of the invention, the liquid comprises water.

In a preferred embodiment of the invention, the apparatus includes a one way valve which allows gas to pass from the exterior of the cylindrical structure to the interior thereof.

In a preferred embodiment of the invention, the liquid comprises an oil.

In a preferred embodiment of the invention, the liquid comprises a mixture of different liquids. Alternatively or additionally the liquid has a vapor pressure affecting material dissolved in it.

In a preferred embodiment of the invention, the apparatus includes a transfer surface on an external cylindrical surface of the cylindrical structure. Preferably, the transfer surface is comprised in a transfer blanket attached to the cylindrical member. Preferably, the transfer blanket comprises at least one solid elastomer layer. Preferably, the transfer blanket does not include any sponge material.

Preferably, the transfer blanket includes an exterior transfer surface and when the transfer surface is heated from within the cylindrical structure to a temperature of 100 degrees Celsius, the cylindrical member is at a temperature no more than 30 degrees Celsius and more preferably no more than 20 degrees Celsius higher than that of the transfer surface.

In a preferred embodiment of the invention, the cylindrical member is a membrane having a thickness of between 50 and 250 micrometers, more preferably between 100 and 200 micrometers and more preferably, 125 micrometers or greater.

Preferably, the cylindrical member is comprised of nickel.

In a preferred embodiment of the invention, the interior of the cylindrical structure is hollow and wherein the liquid fills less than the entire hollow, preferably less than half the hollow, more preferably less than 25% or 10% of the hollow. In a preferred embodiment of the invention only about 5% of the hollow is filled with the liquid.

In a preferred embodiment of the invention, the liquid contacts an interior surface of the cylindrical member. Preferably, as the member rotates, the liquid is carried along the interior surface as a film.

There is further provided, in accordance with a preferred embodiment of the invention, printing apparatus comprising:

an image forming surface on which a visible image is formed; and an intermediate transfer member, according to the invention, which receives the image from the image forming surface and transfers it to another surface.

Preferably, the visible image is a toner image. The toner image is preferably either a liquid or powder toner image.

BRIEF DESCRIPTION OF THE DRAWINGS

The invention will be more clearly understood by reference to the following description of preferred embodiments thereof read in conjunction with the accompanying drawings. Identical structures, elements or parts that appear in more than one of the figures are labeled with the same numeral in all the figures in which they appear.

DETAILED DESCRIPTION OF PREFERRED EMBODIMENTS

Figure 1A:
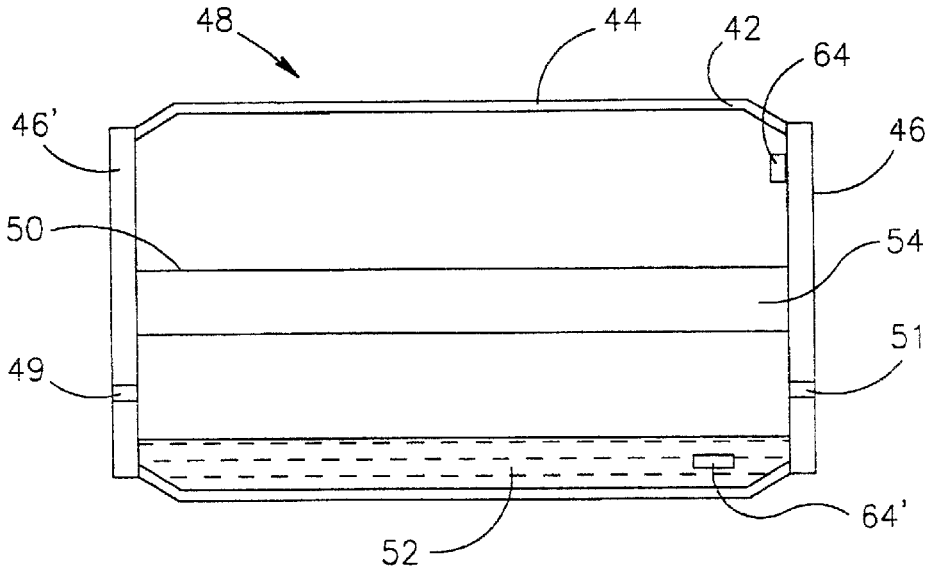
FIG. 1A is a schematic longitudinal cross-sectional illustration of an intermediate transfer member, in accordance with a preferred embodiment of the invention.

Reference is now made to FIG. 1A which shows a longitudinal cross sectional illustration of an intermediate transfer member 40, in accordance with a preferred embodiment of the present invention. Intermediate transfer member 40 comprises:

a) a cylindrical drum 48, preferably comprising a membrane 42 of about 50 to about 250 micrometers thickness, more preferably about 125 micrometers, to which an intermediate transfer blanket 44 is mounted or adhered;

b) intermediate transfer blanket 44 (or optionally a suitable multi-layer coating on drum 48);

c) two end plates, 46 and 46', on which membrane 42 is mounted and attached, by soldering, welding or gluing to form a cylindrical drum 48; and d) a heating element, optionally part of an axial element 50, a preferred embodiment of which is described in detail below (in conjunction with FIGS. 2A and 2B), mounted substantially on the center of end plates 46 and 46'.

Membrane drum 42, which may be too thin to support itself, especially during transfer, is supported by gas pressure within the drum and optionally additionally by mechanically applied pressure on end plates 46 and 46', by axial element 50, to transfer the membrane for image transfer, preferably, transfer of liquid toner images. A gas pressure of about two to three atmospheres has been found suitable for supporting the membrane and providing a desired resilience.

Intermediate transfer blanket 44, is preferably of relatively simple structure. This structure is described in detail below, in conjunction with FIG. 3.

In order to efficiently transfer an image to and from a release layer 114, (see FIG. 3) which is comprised in intermediate transfer blanket 44, membrane drum 42, is desirably maintained at a suitable temperature. It is undesirable for there to be substantial axial temperature variations.

In some preferred embodiments of the present invention, membrane 42, is maintained at a desired temperature by heating a given volume of liquid 52, preferably water or oil, incorporated within cylindrical structure 48. Liquid 52, which forms a "pool" in the lowest portion of drum 42, is preferably heated by an internal heater 54, incorporated in axial element 50. Heater 54 may be a halogen lamp or an electrical resistance or any other heater known in the art. Preferably, an inlet valve 49 is provided for replenishing the liquid as required.

Figure 2A:
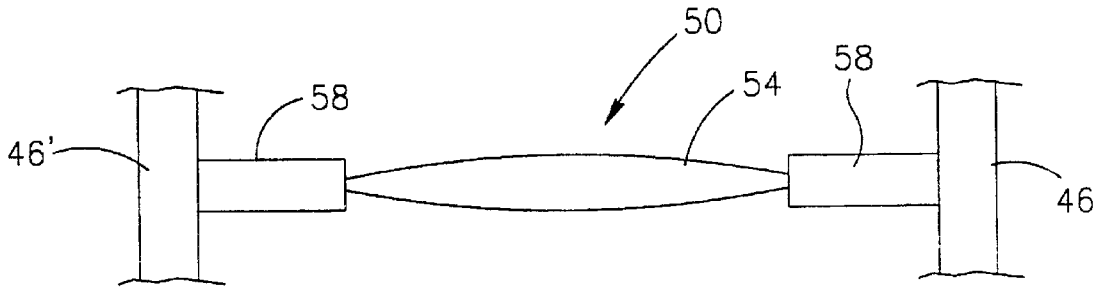
FIG. 2A is a schematic illustration an axial element mounted substantially on the center of end plates of an intermediate transfer element in accordance with a preferred embodiment of the present invention.
Figure 2B:
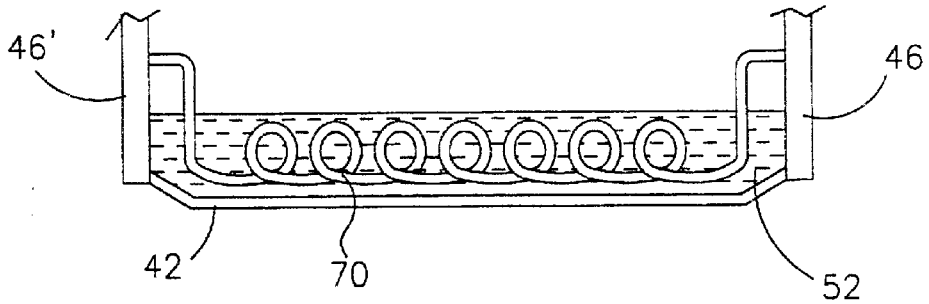
FIG. 2B is a schematic illustration of a heating element immersed in liquid, in accordance with a preferred embodiment of the invention.

FIG. 2A is a schematic illustration of axial element 50, mounted substantially on the center of end plates 46 and 46', of intermediate transfer member 48, in accordance with a preferred embodiment of the present invention. The central portion of axial element 50, comprises a heater 54, which preferably is a halogen lamp. Alternatively, halogen lamp may be replaced by an electrical resistance.

Alternatively, in some preferred embodiments of this invention, liquid 52 may be heated by a heating element (e.g. an electrical resistance) 70 (FIG. 2B), made of a material which is not corrosively attacked by liquid 52. Resistance 70 is positioned and connected to end plates 46 and 46', in such a way as to be immersed in liquid 52. The weight of heating element 70, prevents it from being dragged by the circular movement of intermediate transfer member 48. A rotating electrical connection or a system of commutators inside and outside the drum for providing energy to the heater and bearings are provided at end plates 46 and 46'.

If liquid 52 is water, when heated, it evaporates inside drum 42, where the vapors start to accumulate and a pressure starts to build up. For a given liquid temperature, the pressure created inside drum 42, by vapors of liquid 52 increases up to the point where a steady state equilibrium is reached between the liquid's vapor pressure at that temperature and the vapors above the liquid surface. As the value of the pressure at steady state equilibrium depends on liquid's temperature, the pressure applied by the vapors on the inside walls of drum 42, may be controlled by controlling the liquid temperature.

In some preferred embodiments of the present invention, a pressure sensor 64 and or a temperature sensor 68, are positioned respectively on an end plate's inside surface and in the liquid in order to measure and control both liquid temperature and gas pressure inside drum 42.

Figure 1B:
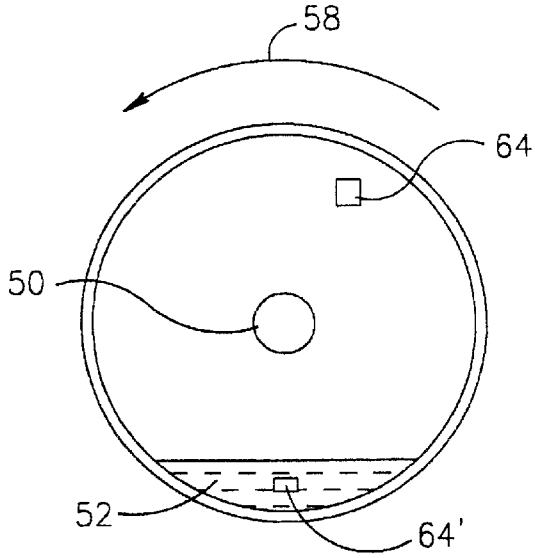
FIG. 1B is a schematic transverse cross-sectional illustration of an intermediate transfer member, in accordance with a preferred embodiment of the invention.

When heated, liquid 52 transfers part of its heat to the portion of drum 42 on which it forms the "pool". By rotating the intermediate transfer member in the direction of arrow 58 in FIG. 1B, the entire inner surface of drum 42, comes in contact with liquid 52, which heats drum 42 to a desired temperature. Further heating of the drum is provided by radiation of heat from heater 54. The heat is then transferred from membrane drum 42 to transfer blanket 44 which is described below in conjunction with FIG. 3. Furthermore, the inner surface of drum 42, when passing through the liquid pool drags a small quantity of liquid 52, which adheres to the membrane and forms a thin coating on the inside surface of drum 42. This liquid coating provides a greater heat capacity to the regions of drum 42, outside liquid pool.

As a consequence of the increased heat capacity of the drum, the above mentioned difficulty in measuring and controlling the drum temperature and temperature variations over surface portions of the drum as a function of angular position are substantially reduced. Even more important an advantage is the decrease in short term memory.

An additional advantage of having water inside the drum to heat the membrane is the vapor pressure that builds inside the drum. For a water temperature of 120° C.–130° C., a pressure of about 2 to 3 ATM. may be obtained. This pressure provides automatic pressure and temperature stabilization of the drum. This pressure is also suitable for maintaining the membrane drum adequately extended and for efficiently transfer an image to and from a transfer blanket, the description of which is given below in conjunction with FIG. 3.

When water is used as heating liquid at temperature and pressure conditions as described above, the intermediate transfer member may operate for long periods of time without refilling the liquid. On the other hand, when oil is used as the heating liquid, such as it is in some preferred embodiments of the present invention, a suitable oil vapor pressure cannot be maintained inside the drum for an oil temperature of 120° C.–130° C. Therefore, in those preferred embodiments of the present invention, where oil replaces water, a pump is used to inject inside the drum a gas, preferably air, in order to maintain the inside pressure at a desired level as in the prior art.

For water systems a one way valve, shown symbolically as 51 on FIG. 1, is preferably used, to assure that the drum does not collapse when cooled. Valve 51 allows for outside air to enter the drum whenever the outside pressure is greater than the inside pressure. This results, effectively, in at least one atmosphere of air pressure in the drum at all times.

In some preferred embodiments of the present invention, regions 58 of axial part 50, (see FIG. 2A), comprise springs which may be loaded, to apply mechanical pressure to end plates 46 and 46', in order to prevent the drum from collapsing when there is no heat. Alternatively or additionally, an additional axial structure may be provided to provide pressure on the plates.

Figure 3:
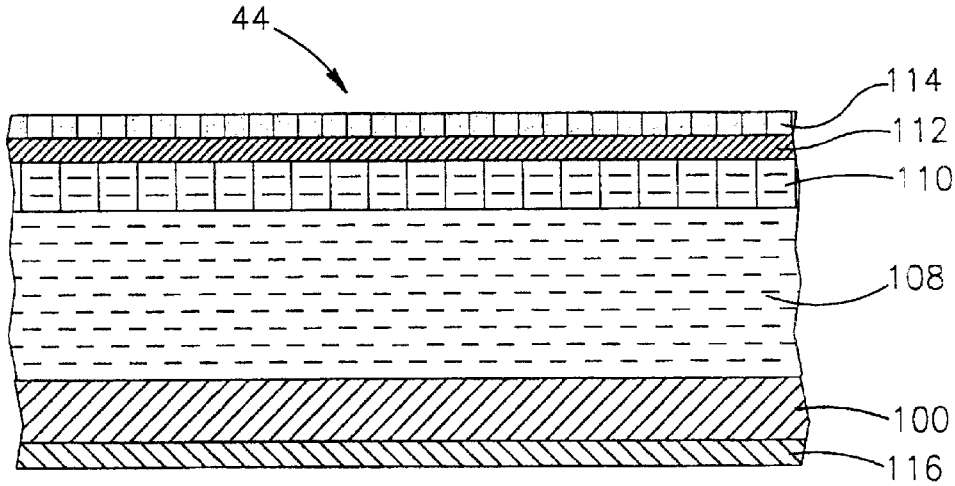
FIG. 3 is a schematic cross sectional illustration of an image transfer blanket, in accordance with a preferred embodiment of the invention.

Reference is now made to FIG. 3 which is a schematic cross sectional illustration of an example of a low mass intermediate transfer member blanket 44, in accordance with a preferred embodiment of the invention. Blanket 44, is preferably formed on a polyester fabric 100 about 110 microns thick, which has been impregnated with a layer of acrylic rubber (HyTemp 4051 EP, Zeon Chemicals), made conductive by loading it with 20 parts of conductive carbon black (XE-2, Degussa) for each 100 parts of rubber together with curing agent (sodium stearate) and accelerator (NPC 50 of Zeon) as specified by the manufacturer. The conductive acrylic rubber is dissolved in toluene, to about 17% solids, and coated onto the fabric so impregnation results. The total thickness of fabric 100, after impregnation, is about 120 microns. It was found that by impregnating the fabric with a conductive material voltage could be passed through the entire thickness of the ITM, obviating the need for a metal clamp.

A soft acrylic rubber film (HyTemp 4051EP, Zeon Chemicals), 108, of about 400 microns thickness, which is loaded with about 20 parts by weight of carbon black (Black Pearls 130, Cabot Corp.) together with curing agent and accelerator as specified by the manufacturer and produced by a calendering technique, is laminated using heat and pressure to the conductive-layer impregnated fabric. The soft acrylic rubber layer, 108, which has a hardness of about 30 shore A, partially replaces the function of the sponge layer in the standard ITM, and allows transfer to difficult substrates such as rough paper.

An additional acrylic rubber layer, 110, (HyTemp 4051 EP, Zeon Chemicals), filled with 40 parts carbon black (Black Pearls 130, Cabot Corp.) to 100 parts of rubber together with curing agent and accelerator as specified by the manufacturer, and yielding a hardness of about 45 shore A, is preferably solution coated on soft acrylic rubber layer 108, yielding a dry film of about 20 microns thickness. This thin, harder film 110 lowers the stickiness of the blanket.

Acrylic rubber layer, 110, is coated by a thin coat of primer, 112, for example, (3-glycidoxypropyl) trimethoxysilane of ABCR, Germany. Primer layer, 112, is then dried by a fan to obtain a dry coating of about 1 micron.

The primer layer is preferably coated by a release layer. A preferred release layer 114, is prepared according to the following procedure: RTV 11 and RTV 41, of General Electric, are separately dissolved in hexane and Isopar-L (Exxon), and centrifuged in order to remove the filler. The liquid is decanted off, to be concentrated by evaporation to a concentration of about 70% and undissolved solids are discarded. 60 parts by weight of concentrated and defillered RTV 11 (based on the dissolved solids) are mixed with 40 parts by weight of concentrated and defillered RTV 41 (based on the dissolved solids), and 1 part by weight of carbon black (Ketjenblack 600, Akzo) is added to the mixture. The mixture of RTV 11, RTV 41 and carbon black is diluted with Isopar-L to about 50% solid monomers. For each 5 gm of solids in the mixture 20%, by weight, of oleic acid (J T Baker), 10%, by weight, of ethyl silicate (Chordip) and 200 microliters of dibutyl tin dilaurate (Aldrich) are added to the solution. After letting the release solution stand at room temperature for about one hour, the release solution is coated onto the blanket layer 112, to obtain a dry film thickness of about 5 microns.

Blanket 44, is then held at room temperature for about 2 hours before a final cure of 3 hours at 110° C. After this last cure, an adhesive layer, 116, is applied to the uncoated side of polyester fabric 100. After having been thus coated, adhesive 116 is dried at 60° C. for about 30 minutes and then cured for about 15 minutes at 110° C. The final thickness of adhesive 116 is about 30 microns. A preferred adhesive 116 is prepared by mixing 2% by weight of benzoyl peroxide (based on the solids) with Q2-7735 silicone pressure sensitive adhesive (Dow Corning).

While the above materials and dimensions represent the best mode of producing a blanket for carrying out the invention, it should be understood that wide variations on the materials and dimensions are possible and that completely different constructions are possible, depending, inter alia on the type of toner used. Furthermore, while the above blanket is suitable for liquid toners, powder toners may advantageously use a different construction, suitable for the mechanisms used for first and second transfer of such toners.

With the sponge layer removed, a thinner, much less expensive blanket may be used. The blanket above described has a much lower thermal resistance. As a consequence, the drum itself needs to be heated to a much lower temperature compared to the temperature required in the prior art. In particular, it has been found that a temperature differential as small as 20 to 30 degrees Celsius is sufficient to efficiently transfer an image using the above described transfer blanket. This lower temperature requirement allows for low temperature adhesives and other components of the blanket and for higher reliability of the blanket. Eliminating the sponge layer eliminates failure of the blanket from paper jams, which is one of the leading causes of blanket failure in prior art transfer blankets.

A transfer blanket such as described above has a shorter nip, compared to prior art transfer blankets (3 mm versus 6+ mm) which have a sponge layer in their structure. A shorter nip appears to improve small dot transfer capability of the blanket. It reduces thermal shock occurrence by providing greater thermal uniformity across the transfer blanket and lowers the electrical current for a given transfer voltage value at the blanket's release layer resulting in higher voltage uniformity over different portions of release layer 114. Transfer blanket 44, is especially suitable for good first transfer of an electrostatic image to an intermediate transfer member. And, as has been noted, transfer blanket 44 is also suitable for transfer and fusing of the image from intermediate transfer member 48 onto a final substrate, such as paper, preferably by heat and pressure.

Figure 4:
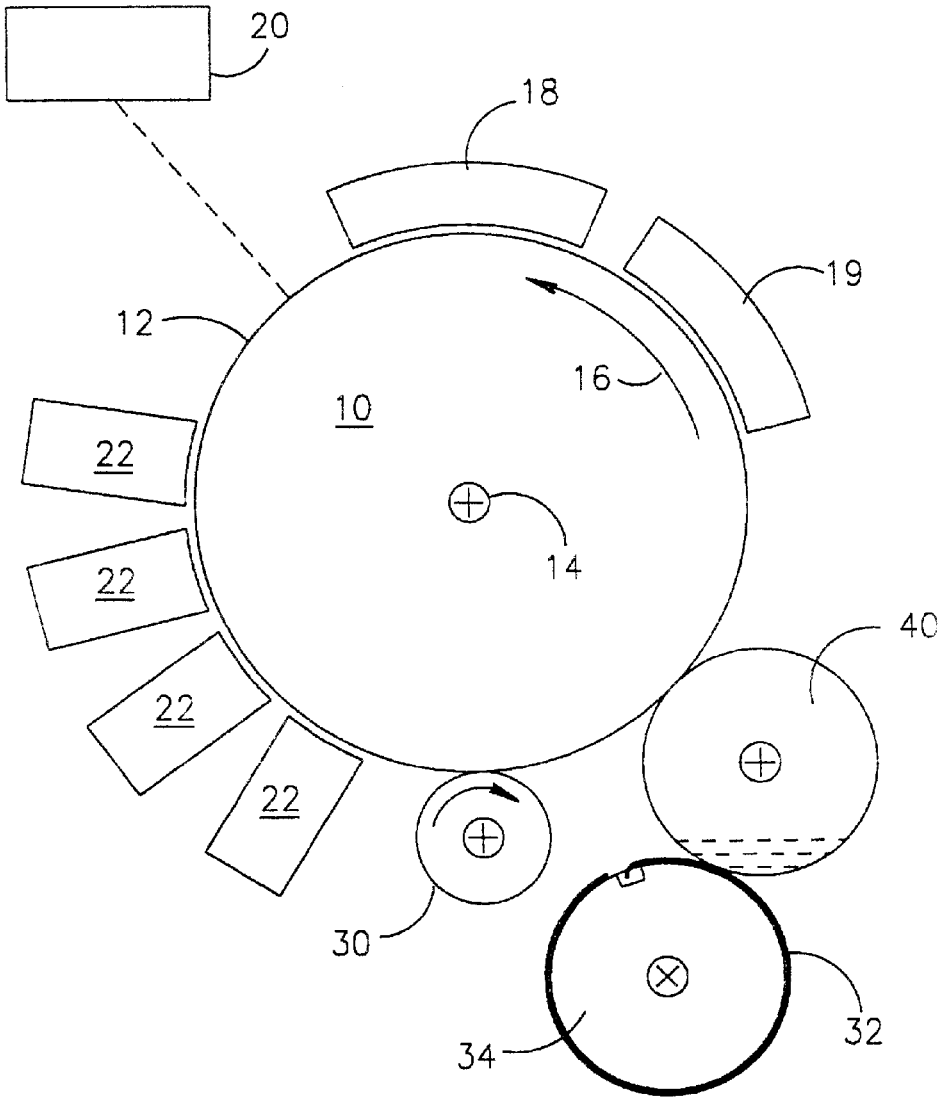
FIG. 4 is a schematic illustration of an imaging system, in accordance with a preferred embodiment of the invention.

The above described preferred embodiments of the present invention, of intermediate transfer member and blanket may be efficiently utilized in an imaging apparatus such as the apparatus schematically illustrated in FIG. 4. For convenience, the apparatus of FIG. 4 is very simplified and does not include many of the details required in such apparatus, since the intermediate transfer member of the invention is useful for a wide variety of existing printers and copiers and since these existing devices need little in the way of substantive redesign. For details of some systems for which the invention is useful, the reader is referred to the documents incorporated herein by reference. It should be noted that the description which follows is presented in the context of an electrophotographic system employing a liquid toner, however, the invention is useful in powder toner systems as well.

The apparatus of FIG. 4 comprises a photoreceptor drum 10, which has a photoconductive surface 12, rotating on a shaft 14. Drum 10 is driven in the direction of arrows 16 such that photoconductive surface 12 moves past a corona discharge device 18 adapted to charge surface 12. An image to be reproduced is focused by a scanner 20 upon surface 12. The areas of surface 12 struck by light conduct the charge, or a portion thereof, to ground, thus forming an electrostatic latent image.

A set of developing stations 22 selectively develop the latent image on surface 12 to form a developed image. Preferably, latent image corresponding to one printed color in the final image is successively formed and developed by one of developers 22 to form a single color (separation) image.

Excess liquid is removed from the developed image by metering apparatus which may incorporate a squeegee roller 30.

Transfer of the image to a carrier sheet 32, such as paper, supported on a roller 34, is effected by an intermediate transfer member 40 as described above in detail. After transfer of the image, any residual toner on surface 12 is removed at cleaning station 19.

In some preferred embodiments of the present invention, especially when liquid 52 (see FIG. 2B) is heated by a heating element 70, immersed in it, drum 10, intermediate transfer member 40, carrier sheet 32 and roller 34 are arranged so as to have carrier sheet 32 brought in contact with intermediate transfer member 40 at between 6 and 9 o'clock as shown. This arrangement enables maximum heating and temperature equalization of the intermediate transfer member at second transfer and a certain amount of cooling of the member prior to first transfer.

In the claims of the present application the verbs, "comprise" and "include" and conjugates thereof "mean including but not necessarily limited to."

While the invention has been described with reference to certain preferred embodiments, various modifications, for example, the use of powder toner, will be readily apparent to and may be readily accomplished by persons skilled in the art without departing from the spirit and the scope of the above teachings. Furthermore, while the present invention has been described in the context of an intermediate transfer member, it should be understood that many aspects of the invention are equally applicable to fusers.

Therefore, it is understood that the invention may be practiced other than as specifically described herein without departing from the scope of the following claims:

1. Apparatus for use as a fuser or intermediate transfer member in an imager, comprising:

a cylindrical member, having a thickness that is insufficient to support it in use, secured to two round end plates to form a cylindrical structure mounted in said apparatus wherein the cylindrical member is unsupported between the endplates;

a liquid incorporated within the cylindrical structure; and a heater that heats the liquid to form vapor therefrom, wherein the vapor is at a sufficient pressure to support the cylindrical member in use.

2. Apparatus according to claim 1 wherein the cylindrical member is a fuser element for fusing images to a sheet.

3. Apparatus according to claim 1 wherein the cylindrical member is an intermediate transfer apparatus for transferring visible images from a first surface to a second surface.

4. Printing apparatus comprising:

an image forming surface on which a visible image is formed; and an intermediate transfer member according to claim 3, mounted in the printing apparatus, which receives the image from the image forming surface and transfers it to another surface.

5. Printing apparatus according to claim 4 wherein the visible image is a toner image.

6. Printing apparatus according to claim 5 wherein the toner image is a liquid toner image.

7. Printing apparatus according to claim 5 wherein the image is a powder toner image.

8. Apparatus according to claim 2 wherein the heater heats the liquid and the cylindrical member to a temperature between about 110 degrees Celsius and about 140 degrees Celsius.

9. Apparatus according to claim 2 wherein the heater heats the liquid and the cylindrical member to a temperature between about 115 degrees Celsius and about 135 degrees Celsius.

10. Apparatus according to claim 2 wherein the heater heats the liquid and the cylindrical member to a temperature between about 120 degrees Celsius and about 130 degrees Celcius.

11. Apparatus according to claim 1 wherein the heater is a radiant heater situated in the interior of the cylindrical structure.

12. Apparatus according to claim 1 wherein the heater is a conduction heater placed in a pool of the liquid in the cylindrical structure.

13. Apparatus according to claim 2 wherein the cylindrical member forms a seal at the end plates.

14. Apparatus according to claim 2 wherein the pressure is equal to between about 2 and about 3 atmospheres.

15. Apparatus according to claim 2 wherein the liquid comprises water.

16. Apparatus according to claim 2 and including a one way valve which allows gas to pass from the exterior of the cylindrical structure to the interior thereof.

17. Apparatus according to claim 2 wherein the liquid comprises an oil.

18. Apparatus according to claim 2 wherein the liquid comprises a mixture of different liquids.

19. Apparatus according to claim 1 wherein the liquid has a vapor pressure affecting material dissolved in it, said material being effective to modify the relationship between vapor pressure and temperature of the liquid.

20. Apparatus according to claim 3 and including a blanket attached to the cylindrical member.

21. Apparatus according to claim 20 wherein the blanket comprises at least one solid elastomer layer.

22. Apparatus according to claim 21 wherein the blanket does not include any sponge material.

23. Apparatus according to claim 20 wherein the blanket includes an exterior surface and wherein when the exterior surface is heated from within the cylindrical structure to a temperature of 100 degrees Celsius, the cylindrical member is at a temperature no more than 30 degrees Celsius higher than that of the cylindrical member.

24. Apparatus according to claim 23 wherein the cylindrical member is at a temperature no more than 20 degrees Celsius higher than that of the exterior surface.

25. Apparatus according to claim 2 wherein the cylindrical member is a membrane having a thickness of between 50 and 250 micrometers.

26. Apparatus according to claim 25 wherein the thickness of the membrane is between 100 and 200 micrometers.

27. Apparatus according to claim 25 wherein the thickness of the membrane is 125 micrometers or greater.

28. Apparatus according to claim 1 wherein the cylindrical member is comprised of nickel.

29. Apparatus according to claim 2 wherein the interior of the cylindrical structure is hollow and wherein the liquid fills less than the entire hollow.

30. Apparatus, according to claim 29, wherein the hollow is less than half filled with the liquid.

31. Apparatus according to claim 29 wherein the hollow is less than one-quarter filled with the liquid.

32. Apparatus according to claim 29 wherein the hollow is less than 10% filled with the liquid.

33. Apparatus according to claim 29 wherein the hollow is about 5% filled with the liquid.

34. Apparatus according to claim 1 wherein the liquid contacts an interior surface of the cylindrical member.

35. Apparatus according to claim 34 wherein as the member rotates, the liquid is carried along the interior surface as a film.

36. Apparatus according to claim 3 wherein the heater heats the liquid and the cylindrical member to a temperature between about 110 to degrees Celsius and about 140 degrees Celsius.

37. Apparatus according to claim 36 wherein the heater heats the liquid and the cylindrical member to a temperature between about 115 degrees Celsius and about 135 degrees Celsius.

38. Apparatus according to claim 37 wherein the heater heats the liquid and the cylindrical member to a temperature between about 120 degrees Celsius and about 130 degrees Celsius.

39. Apparatus according to claim 3 wherein the cylindrical member forms a seal at the end plates.

40. Apparatus according to claim 3 wherein the pressure is equal to between about 2 and about 3 atmospheres.

41. Apparatus according to claim 3 wherein the liquid comprises water.

42. Apparatus according to claim 3 and including a one way valve which allows gas to pass from the exterior of the cylindrical structure to the interior thereof.

43. Apparatus according to claim 3 wherein the liquid comprises an oil.

44. Apparatus according to claim 3 wherein the liquid comprises a mixture of different liquids.

45. Apparatus according to claim 3 wherein the cylindrical member is a membrane having a thickness of between 50 and 250 micrometers.

46. Apparatus according to claim 45 wherein the thickness of the membrane is between 100 and 200 micrometers.

47. Apparatus according to claim 45 wherein the thickness of the membrane is 125 micrometers or greater.

48. Apparatus according to claim 3 wherein the interior of the cylindrical structure is hollow and wherein the liquid fills less than the entire hollow.

49. Apparatus, according to claim 48, wherein the hollow is less than half filled with the liquid.

50. Apparatus according to claim 48 wherein the hollow is less than one-quarter filled with the liquid.

51. Apparatus according to claim 50 wherein the hollow is less than 10% filled with the liquid.

52. Apparatus according to claim 50 wherein the hollow is about 5% filled with the liquid.

* * * * *

UNITED STATES PATENT AND TRADEMARK OFFICE

CERTIFICATE OF CORRECTION

PATENT NO. : 6,584,294 B1
APPLICATION NO. : 09/856649
DATED : June 24, 2003
INVENTOR(S) : Benzion Landa et al.

It is certified that error appears in the above-identified patent and that said Letters Patent is hereby corrected as shown below:

Title page, item (56) line 1, References Cited, OTHER PUBLICATIONS add --NEC CORP; JP 08-320625; December 3, 1996 & Patent Abstracts of Japan; Vol. 1997; No. 04; April 30, 1997--
Claim 36, line 12, after "110" remove "to"

Signed and Sealed this

Seventeenth Day of April, 2007

JON W. DUDAS
*Director of the United States Patent and Trademark Office*